US005150003A

United States Patent [19]

Shin

[11] Patent Number: 5,150,003

[45] Date of Patent: Sep. 22, 1992

[54] SEPARATOR FOR DEFLECTION YOKE

[75] Inventor: Hyunjeong Shin, Hwasung, Rep. of Korea

[73] Assignee: Samsung Electronics, Kyunggi, Rep. of Korea

[21] Appl. No.: 651,556

[22] Filed: Feb. 6, 1991

[30] Foreign Application Priority Data

Apr. 19, 1990 [KR] Rep. of Korea ..... 90-5004

[51] Int. Cl.[5] ..... H01J 29/70

[52] U.S. Cl. ..... 313/440; 335/212; 358/248; 358/249

[58] Field of Search ..... 313/440; 335/212; 358/248, 249

[56] References Cited

U.S. PATENT DOCUMENTS 3,163,794 12/1964 Bloomsburgh et al. ..... 313/440 X

*Primary Examiner*—Sandra L. O'Shea

*Attorney, Agent, or Firm*—Cushman, Darby & Cushman

[57] ABSTRACT

A deflection yoke separator is disclosed, and the separator includes a convergence correcting means and a neck holder consisting of two outer pieces and an intermediate piece. The outer lower portion of each of the outer pieces of the neck holder is provided with a reinforcing portion, and the reinforcing portion is provided with an insertion slot. The lower portion of the intermediate portion is provided with a stepped portion for matching the height with the insertion slot, and the stepped portion is provided with a guide projection in the circumferential direction in alignment with the center line of the insertion slot. The correcting means M is provided with an elongate guide slot in its lengthwise direction, and therefore, the correcting means can be slided easily along the guide projection.

3 Claims, 3 Drawing Sheets

SEPARATOR FOR DEFLECTION YOKE

BACKGROUND OF THE INVENTION (1) Field of the Invention

The present invention relates to a separator for deflection yoke, and particularly to a deflection yoke separator which not only exactly adjusts the convergence of electron beams, but also reinforces the strength of the neck portion of the deflection yoke.

(2) Description of the Prior Art

In a shadow mask type color television, R, G, B electron beams projected from an electron gun pass through a hole formed in the shadow mask simultaneously, and land on the relevant phosphorescent dots, thereby producing the intended colors. Under this condition, if the three colors are not correctly combined, the color is deviated, or other problems are produced.

The above mentioned problematic phenomenon can occur over the whole picture, or it is confined to the peripheral portions of the picture. In the former case, the deviation of the convergence of the R, G, B beams is the cause, while, in the latter case, the faulty phenomenon is attributed to the difference between the curvature of the phosphor face and the curvature of the beam receiving face.

Meanwhile, the distance between the deflecting centre of the deflection coil and the face of the shadow mask are varied at each moment by the momentary deflecting position, and therefore, it is known to be a difficult task to correct the misconvergence.

Such correction of the convergence is classified into a dynamic correction and a static correction, the dynamic correction being carried out by manipulating the electron gun and the deflection yoke, and the static correction being carried out by varying the magnetic fields of the deflection yoke through attachment of a steel piece or a magnet on the proper position.

Meanwhile, the deflection yoke is formed through a medium of a separator taking a separated symmetrical form, and, in carrying out the static correction, an object is attached on the separator.

FIG. 3 is an exploded perspective view of the conventional separator employing the above described method, and as shown in this drawing, the separator takes a trumpet shaped body A consisting of a combination of two symmetrical pieces. The trumpet shaped body A comprises: a neck holder H surrounding the neck of the cathode ray tube, and a flange F extended in a direction perpendicular to the axis of the holder H. In carrying out the static correction according to the conventional method, correcting means M such as steel pieces or magnets are attached at the proper places on both the neck holder H and the flange F.

However, in carrying out the correcting by using the objects, the worker has to watch the picture state and at the same time has to adjust the position of the magnet to decide the proper position. Then, the steel pieces or the magnets are attached by means of an adhesive. However, the exploring and deciding of the proper positions are not easy for the neck holder H, although it may by easy for the flange F.

That is, the correcting means M such as steel pieces and magnets take an arcuate shape so as for them to be attachable on the outer surface of the neck holder H. In deciding the positions of the correcting means, the worker has to turn the pieces around the neck holder H, but there is no means temporarily fixing the pieces.

Therefore it is difficult to decide the exact position, and further, when attaching the pieces by means of an adhesive after the deciding of the positions, it is no less difficult to find out the predetermined positions.

Such difficulties act as an impediment not only for the productivity but also for the product quality.

SUMMARY OF THE INVENTION

The present invention is intended to overcome the above described disadvantages of the conventional technique.

Therefore it is the object of the present invention to provide a separator for deflection yoke, in which, when attaching the arcuate correcting means on the neck holder, the attachment can be carried out in an exact and easy manner, thereby making it possible to carry out the static correction of the convergence in an easy manner.

In achieving the above object, the deflection yoke separator according to the present invention is constituted such that: insertion slots for temporarily securing the convergence correcting means are formed in an opposingly facing manner on the joining portion between the neck holder and the flange; and a guide projection is provided in such a manner as to be disposed between the insertion slots and to be rotatable around the neck holder, thereby making it possible to temporarily fix the correcting means.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 1:
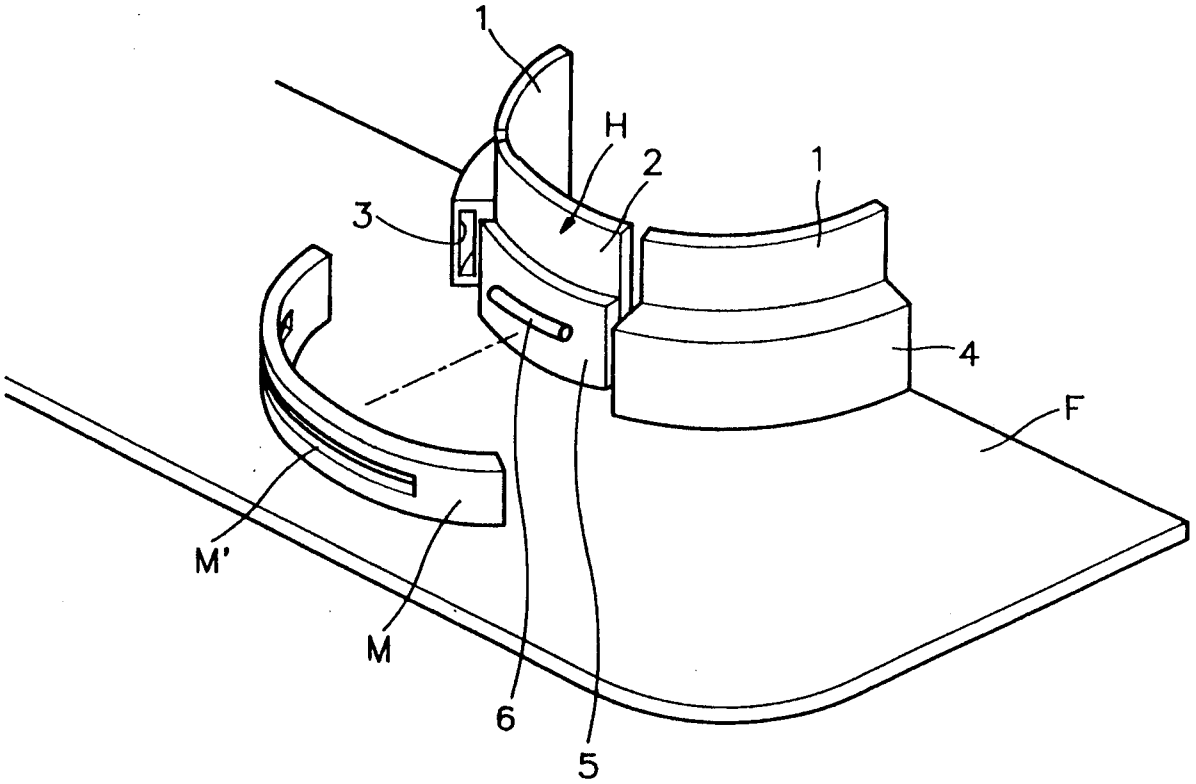
FIG. 1 is a perspective view of a part of the separator according to the present invention.

FIG. 1 illustrates the preferred embodiment of the separator for deflection yoke according to the present invention, and this drawing shows in an enlarged perspective view the joining portion between the neck holder H and the flange F of the separator A.

Referring to FIG. 1, the neck holder H consists of two outer pieces 1 and an intermediate piece 2; a reinforcing portion 4 is formed on each of the lower portions of the outer pieces 2; an insertion slot 3 is formed into the reinforcing portion 4; the intermediate piece 2 is provided with a stepped portion 5 for matching the height with the insertion slots 3 and disposed between the reinforcing portions 4; and the stepped portion 5 is provided with a guide projection 6 projected in the circumferential direction and aligned with the centre line of the insertion slots 3.

The guide projection 6 performs the role of temporarily securing a correcting means M which is to be attached to the circumferential lower portion of the neck holder H, and further, the guide projection 6 guides the correcting means M when performing the position exploration.

In a manner to be matched with the guide projection 6, the correcting means M according to the present invention is provided with an elongate slot M' formed in the circumferential direction.

Figure 2:
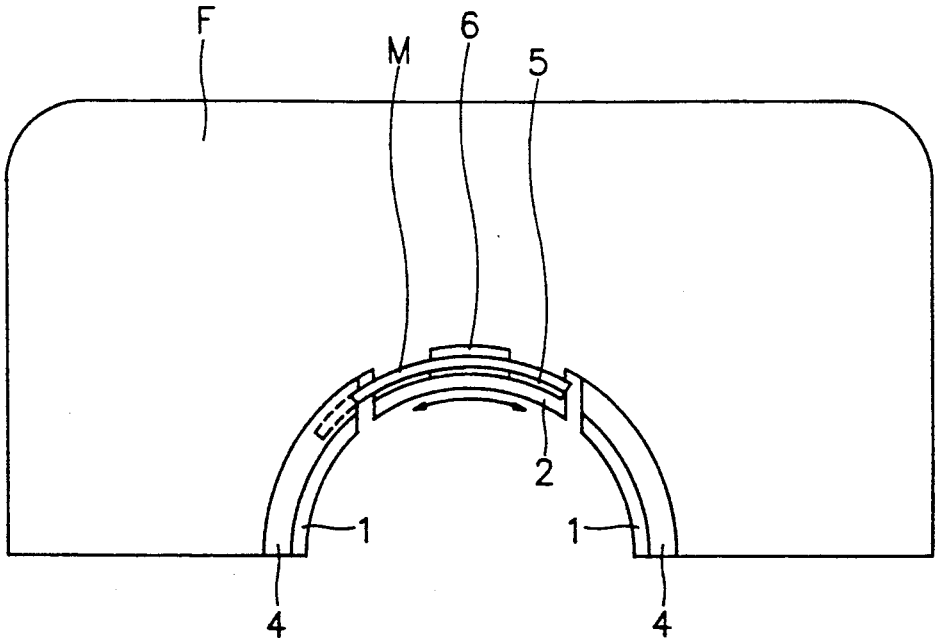
FIG. 2 is a plan view showing the actuating state of the separator of the present invention for adjusting the convergence.
Figure 3:
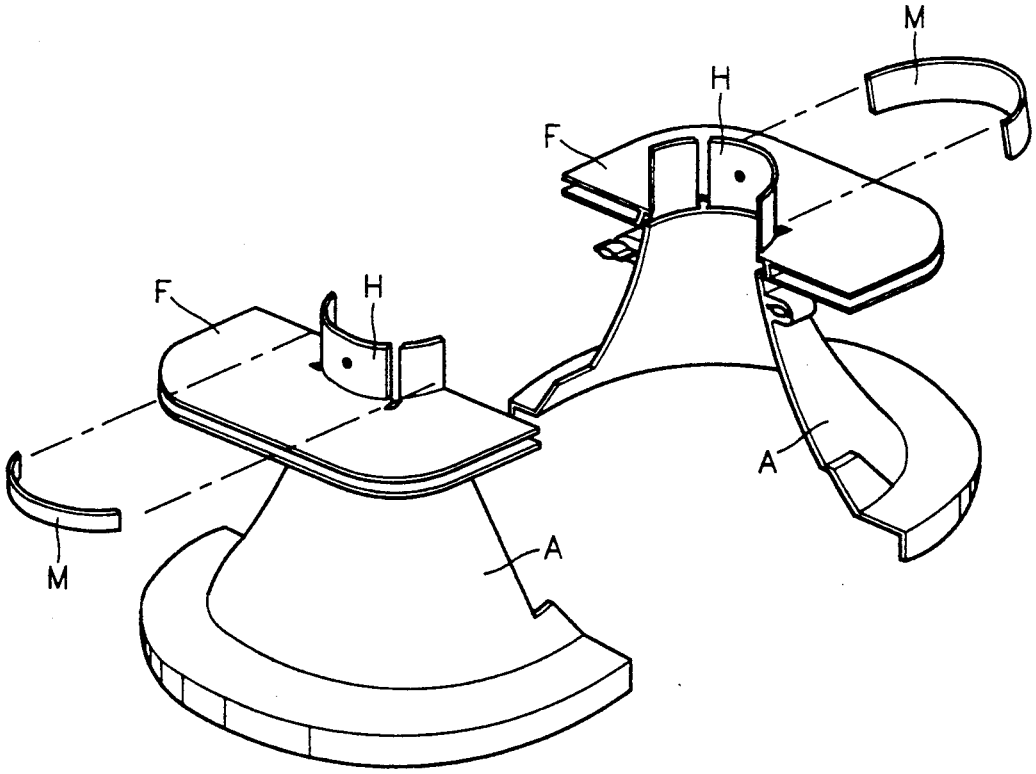
FIG. 3 (Prior Art)
FIG. 3 is an exploded perspective view of the conventional separator.

The deflection yoke separator of the present invention constituted as described above will be operated in manner described below. That is, as shown in FIG. 2, the correcting means M is put to the circumferential surface of the neck holder H, and then, the correcting means M is temporarily secured in such a manner that the elongate guide slot M' can be slided along the guide projection 6. Then, the worker pushes the correcting means M slidably little by little in the direction of the arrow mark of the drawing.

When the attaching position is decided through the above described process, an adhesive is applied to the peripheral edges of insertion slots 3 where the ends of the correcting means M are inserted, in a state with the correcting means M temporarily secured, thereby completing the whole process of the static correction.

According to the present invention as described above, when moving the correcting means along the outer circumferential surface of the neck holder for performing a static correction, the correcting means is guided by the guide projection, and therefore, an exact correction can be performed without deviation. Further, the lower portion of the neck holder which has usually a weak strength upon being attached to the neck portion of the cathode ray tube is strongly reinforced by the reinforcing portions. Therefore, a postural deviation of the deflection yoke due to the weakness of the neck holder is eliminate. Thus, an enhancement of the workability is realized so as for the productivity to be improved, and a correct convergence correction can be achieved, thereby improving the product quality.

What is claimed is:

1. A separator for a deflection yoke which is used as a neck holder surrounding the neck of a cathode ray tube comprising:

a flange with a semicircular hole on one side which is as large as the neck of a cathode ray tube;

two curved members, where a lower portion is perpendicularly attached to said flange, with a circumferentially raised reinforcing portion containing an insertion slot formed on an outer surface of said lower portion of said curved members;

an intermediate curved member with a raised lower portion substantially flush with said insertion slot of said curved members and a guide projection on said raised lower portion formed in the circumferential direction and is in alignment with the center line of said insertion slot; and a correcting means for correcting the convergence of electronic beams, wherein said correcting means has a centered elongated guide slot formed in the lengthwise direction to allow said correcting means to slide along said guide projection.

2. A separator for a deflection yoke according to claim 1, wherein said correcting means is made of metal.

3. A separator for a deflection yoke according to claim 1, wherein said correcting means is made of magnetic material.

* * * * *